US008241010B2

(12) United States Patent
Esch et al.

(10) Patent No.: US 8,241,010 B2
(45) Date of Patent: Aug. 14, 2012

(54) HYDRAULIC RESERVOIR FOR HYDRAULIC REGENERATIVE CIRCUIT

(75) Inventors: Uwe Esch, Dortumund (DE); Robert Weber, Wadsworth, IL (US)

(73) Assignee: Caterpillar Global Mining LLC, South Milwaukee, WI (US)

( * ) Notice: Subject to any disclaimer, the term of this patent is extended or adjusted under 35 U.S.C. 154(b) by 380 days.

(21) Appl. No.: 12/629,991

(22) Filed: Dec. 3, 2009

(65) Prior Publication Data

US 2011/0135502 A1 Jun. 9, 2011

(51) Int. Cl.
*F04B 41/04* (2006.01)
*F15B 11/08* (2006.01)

(52) U.S. Cl. ..... 417/237; 91/436

(58) Field of Classification Search ..... 417/53, 417/410.1, 237, 313; 60/413, 419; 137/574; 220/500; 91/436, 318
See application file for complete search history.

(56) References Cited

U.S. PATENT DOCUMENTS

| | | | | |
|---|---|---|---|---|
| 2,559,125 | A * | 7/1951 | Lee | 60/477 |
| 2,930,322 | A * | 3/1960 | Spencer | 222/333 |
| 3,002,355 | A | 10/1961 | Brackin | |
| 3,091,929 | A * | 6/1963 | Hipp | 60/419 |
| 3,993,094 | A * | 11/1976 | Spooner | 137/588 |
| 4,043,127 | A * | 8/1977 | Kubik | 60/453 |
| 4,089,621 | A * | 5/1978 | Brown | 417/118 |
| 4,152,970 | A * | 5/1979 | Hall et al. | 91/318 |
| 4,204,405 | A * | 5/1980 | Basham | 60/371 |
| 4,210,176 | A * | 7/1980 | Emming | 137/573 |
| 4,295,539 | A * | 10/1981 | Beck et al. | 180/243 |
| 4,297,846 | A | 11/1981 | Cadeddu | |
| 4,340,257 | A * | 7/1982 | Belart | 303/114.1 |
| 4,414,810 | A | 11/1983 | Reinartz et al. | |
| 4,531,368 | A | 7/1985 | Killen | |
| 4,809,745 | A * | 3/1989 | Hormann | 137/574 |
| 5,046,309 | A * | 9/1991 | Yoshino | 60/445 |
| 5,246,346 | A * | 9/1993 | Schiesser | 417/363 |

(Continued)

FOREIGN PATENT DOCUMENTS

| | | |
|---|---|---|
| JP | 04-279837 | 3/2009 |

(Continued)

OTHER PUBLICATIONS

International Search Report and Written Opinion for International Application No. PCT/US2010/058752, mail date Aug. 22, 2011, 7 pages.

*Primary Examiner* — Charles Freay
*Assistant Examiner* — Alexander Comley
(74) *Attorney, Agent, or Firm* — Foley & Lardner LLP

(57) ABSTRACT

A hydraulic reservoir includes a container having an internal volume, an internal wall dividing the internal volume of the container into a first section and a second section for separately containing the hydraulic fluid, and two one-way valves. The first one-way valve allows the hydraulic fluid to be drawn out of the first section of the hydraulic reservoir and substantially prevents a flow of the hydraulic fluid back into the first section. The second one-way valve allows the hydraulic fluid to be returned to the second section of the hydraulic reservoir and substantially prevents a flow of the hydraulic fluid out of the second section. A cooling/filtering loop may connect the second section and the first section such that the used fluid in the second section may be processed and returned to the first section in a substantially unused condition.

15 Claims, 6 Drawing Sheets

U.S. PATENT DOCUMENTS

| | | | | |
|---|---|---|---|---|
| 5,918,760 | A * | 7/1999 | Frodin et al. | 220/661 |
| 5,951,857 | A | 9/1999 | Osborne | |
| 5,975,257 | A | 11/1999 | Roach | |
| 6,227,221 | B1 * | 5/2001 | Schmitz | 137/1 |
| 6,438,951 | B2 * | 8/2002 | Morgan | 60/419 |
| 6,652,239 | B2 * | 11/2003 | Carstensen | 417/44.11 |
| 6,715,403 | B2 * | 4/2004 | Hajek et al. | 91/531 |
| 6,834,737 | B2 * | 12/2004 | Bloxham | 180/165 |
| 6,854,479 | B2 * | 2/2005 | Harwood | 137/362 |
| 6,922,992 | B1 * | 8/2005 | Morgan | 60/484 |
| 6,971,463 | B2 * | 12/2005 | Shore et al. | 180/165 |
| 7,040,214 | B2 * | 5/2006 | Cossette et al. | 91/420 |
| 7,100,632 | B2 * | 9/2006 | Harwood | 137/362 |
| 7,261,123 | B2 * | 8/2007 | Kim | 137/550 |
| 7,562,615 | B2 * | 7/2009 | Abe et al. | 91/436 |
| 2002/0003000 | A1 * | 1/2002 | Evanovich et al. | 137/574 |
| 2005/0188688 | A1 * | 9/2005 | Best et al. | 60/413 |
| 2006/0162543 | A1 * | 7/2006 | Abe et al. | 91/418 |
| 2007/0131287 | A1 * | 6/2007 | Schmitz | 137/558 |
| 2007/0163758 | A1 * | 7/2007 | Welsch | 165/120 |
| 2007/0266796 | A1 * | 11/2007 | Long et al. | 73/862.08 |
| 2008/0104953 | A1 * | 5/2008 | Vigholm | 60/413 |
| 2008/0230337 | A1 * | 9/2008 | Kajiyama et al. | 188/352 |

FOREIGN PATENT DOCUMENTS

| | | |
|---|---|---|
| KR | 20-1999-031380 | 7/1999 |

* cited by examiner

HYDRAULIC RESERVOIR FOR HYDRAULIC REGENERATIVE CIRCUIT

CROSS-REFERENCE TO RELATED APPLICATION

Not applicable.

STATEMENT OF FEDERALLY SPONSORED RESEARCH OR DEVELOPMENT

Not applicable.

BACKGROUND OF THE INVENTION

This invention relates to a hydraulic system. In particular, this invention relates to a hydraulic reservoir for connection to a hydraulic regenerative circuit.

Many mining machines or earth moving equipment utilize hydraulics to actuate movement of their components. During their operation, such machines may have pumps that draw hydraulic fluids into a cylinder to actuate a piston contained therein. Given the mass of the components driven by the expansion and/or retraction of the piston within the cylinder, great amounts of energy may be expended performing even the simplest movements, such as the raising and lowering of components.

Hydraulic regenerative circuits have been developed to recapture some of the energy on the return path of stroke. See e.g., U.S. Pat. Nos. 5,046,309; 6,438,951; and 7,562,615. Typically, as the hydraulic fluid is evacuated from the cylinder, the energy from the backwards flow of the fluid is captured in some way so that this energy can be used to power some other aspect the machine.

However, hydraulic regenerative circuits present unique problems for the storage and cleaning of the hydraulic fluid between stroke cycles. In many cases, the fluid changes in quality as it is used, and may become hot or dirty relative to the original fluid. On the return stroke, there is the potential for this hot, dirty fluid to mix with any cold, clean fluid in the reservoir. Accordingly, filtration and/or other processing of the used hydraulic fluid becomes difficult and it may be necessary to temporarily halt operation of the machine and/or replace the hydraulic fluid if the qualities of the hydraulic fluid become sufficiently unacceptable for use.

Hence, there is a need for improved hydraulic systems incorporating hydraulic regenerative circuits. In particular, there is a need for a hydraulic system that improves the utilization of the hydraulic fluid.

SUMMARY OF THE INVENTION

Used and unused fluids are prone to mix in the hydraulic reservoir given that the fluids alternately flow forward and backward during the operation of a hydraulic regenerative circuit. However, the disclosed hydraulic reservoir, hydraulic system including the hydraulic reservoir, and method of operating the hydraulic system uniquely solves the mixing problem. The hydraulic reservoir is constructed such that mixing of unused and used hydraulic fluid is substantially prevented in the hydraulic reservoir. At the same time, the used and unused fluids are separated such that the used fluid may be cleaned and/or cooled before reintroducing the fluid to the hydraulic regenerative circuit at a substantially unused quality. Further, as the two sections of the reservoir may be formed from a single compartment, the design is compact and, therefore, does not require the fabrication of two separate reservoirs.

A hydraulic reservoir for a hydraulic regenerative circuit is disclosed. The hydraulic regenerative circuit includes an electric motor that is operably coupled to a hydraulic pump that is in selective fluid communication with the hydraulic reservoir. The hydraulic regenerative circuit is operable in a non-regenerative mode and a regenerative mode. In the non-regenerative mode, the electric motor drives the operation of the hydraulic pump to draw a hydraulic fluid from the hydraulic reservoir. In the regenerative mode, the hydraulic pump drives the operation of the electric motor as the hydraulic fluid is returned to the hydraulic reservoir. The hydraulic reservoir includes a container having an internal volume. An internal wall divides the internal volume of the container into a first section and a second section for separately containing the hydraulic fluid. The hydraulic reservoir includes a first one-way valve and a second one-way valve. The first one-way valve allows the hydraulic fluid to be drawn out of the first section and substantially prevents a flow of the hydraulic fluid back into the first section through the first one-way valve. The second one-way valve allows the hydraulic fluid to be returned to the second section and substantially prevents a flow of the hydraulic fluid back out of the second section through the second one-way valve.

The hydraulic reservoir may prevent the mixing of a used hydraulic fluid with an unused hydraulic fluid. In the non-regenerative mode, the hydraulic reservoir may provide a hydraulic fluid from the first section into the hydraulic regenerative circuit without the hydraulic fluid substantially flowing back into the first section or flowing into the second section. In the regenerative mode, the hydraulic fluid may flow from the hydraulic regenerative circuit into the second section without the hydraulic fluid in the second section substantially flowing back into the hydraulic regenerative circuit or flowing into the first section. Depending on the particular conditions of use, the first section may hold a clean and/or cold hydraulic fluid and the second section may hold a dirty and/or hot hydraulic fluid. The internal wall may isolate the clean/cold hydraulic fluid from the dirty/hot hydraulic fluid.

The one-way valves on the hydraulic reservoir may be configured for attachment to specific parts of a hydraulic circuit. The first one-way valve may be adapted for connection to a suction header. The second one-way valve may be adapted for connection to a return manifold. At least one of the first one-way valve and the second one-way valve may be a flapper valve that allows the hydraulic fluid to flow in only one direction through the valve.

The internal wall may prevent the mixture of the hydraulic fluid in the first section and the second section, but still allow for gaseous interchange in a space above the first section and the second section.

A hydraulic system is also disclosed. The hydraulic system includes a hydraulic reservoir connected to a hydraulic regenerative circuit. The hydraulic reservoir includes a container having an internal volume, an internal wall dividing the internal volume of the container into a first section and a second section for separately containing a hydraulic fluid, and a first and a second one-way valve. The first one-way valve allows the hydraulic fluid to be drawn out of the first section and substantially prevents a flow of the hydraulic fluid back into the first section through the first one-way valve. The second one-way valve allows the hydraulic fluid to be returned to the second section and substantially prevents a flow of the hydraulic fluid back out of the second section through the second one-way valve. The hydraulic regenerative circuit includes a hydraulic pump in selective fluid communication with the hydraulic reservoir and an electric motor operably coupled to the hydraulic pump. The hydraulic regenerative circuit is operable in a non-regenerative mode and a regenerative mode. In the non-regenerative mode, the electric motor drives an operation of the hydraulic pump to draw a hydraulic fluid from the hydraulic reservoir. In the a regenerative mode, the hydraulic pump drives an operation of the electric motor as the hydraulic fluid is returned to the hydraulic reservoir.

The hydraulic reservoir may prevent the mixing of a used hydraulic fluid with an unused hydraulic fluid. In the non-regenerative mode, the hydraulic reservoir may provide a hydraulic fluid from the first section into the hydraulic regenerative circuit without the hydraulic fluid substantially flowing back into the first section or flowing into the second section. In the regenerative mode, the hydraulic fluid may flow from the hydraulic regenerative circuit into the second section without the hydraulic fluid in the second section substantially flowing back into the hydraulic regenerative circuit or flowing into the first section.

The first one-way valve may be connected to a suction header and the second one-way valve may be connected to a return header. The suction header and the return header may be placed in valveless fluid communication with the hydraulic pump and with one another.

The hydraulic system may further include a post-use loop. The post-use loop may include a hydraulic pump, a cooling element, and/or a filtering element for taking the used hydraulic fluid in the second section and returning the hydraulic fluid to the first section in a substantially unused condition.

A method is also disclosed of operating a hydraulic system including a hydraulic regenerative circuit attached to a hydraulic reservoir such that an unused hydraulic fluid and a used hydraulic fluid remain substantially unmixed in the hydraulic reservoir. The method includes providing the hydraulic reservoir. The hydraulic reservoir includes a container having an internal wall dividing an internal volume of the container into a first section and a second section for separately containing the unused hydraulic fluid and the used hydraulic fluid, respectively; a first one-way valve that allows the unused hydraulic fluid to flow from the first section into the hydraulic regenerative circuit, but substantially prevents the a flow of the used hydraulic fluid in the hydraulic regenerative circuit back into the first section through the first one-way valve; and a second one-way valve that allows the used hydraulic fluid in the hydraulic regenerative circuit to flow into the second section, but substantially prevents the used hydraulic fluid from flowing back into the hydraulic regenerative circuit through the second one-way valve. Further according to the method, during a non-regenerative phase, an electric motor is used to drive a hydraulic pump to draw the unused hydraulic fluid from the first section of the hydraulic reservoir into the hydraulic regenerative circuit. During a regenerative phase, the hydraulic pump drives the electric motor as the used hydraulic fluid is transported into the second section of the hydraulic reservoir from the hydraulic regenerative circuit.

The method may further include the step of pumping the fluid from the second section through a post-use loop into the first section, wherein the post-use loop contains at least one of a hydraulic pump, a cooling element, and a filtering element that returns the hydraulic fluid from the second section into the first section in a substantially unused condition.

These and still other advantages of the invention will be apparent from the detailed description and drawings. What follows is merely a description of some preferred embodiments of the present invention. To assess the full scope of the invention the claims should be looked to as these preferred embodiments are not intended to be the only embodiments within the scope of the claims.

DETAILED DESCRIPTION OF THE PREFERRED EMBODIMENTS

Figure 1:
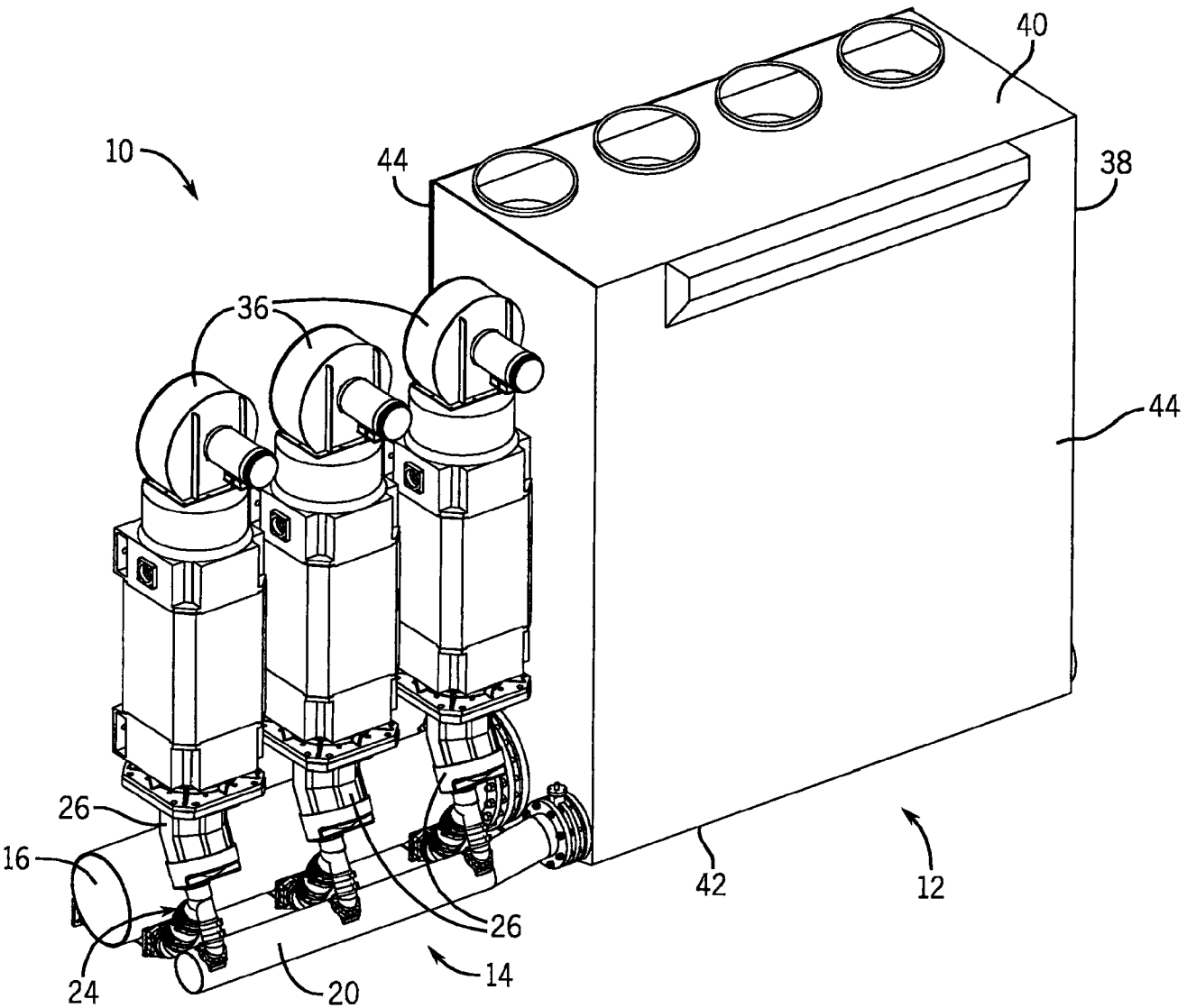
FIG. 1 is a perspective view of a hydraulic system including a hydraulic reservoir.
Figure 2:
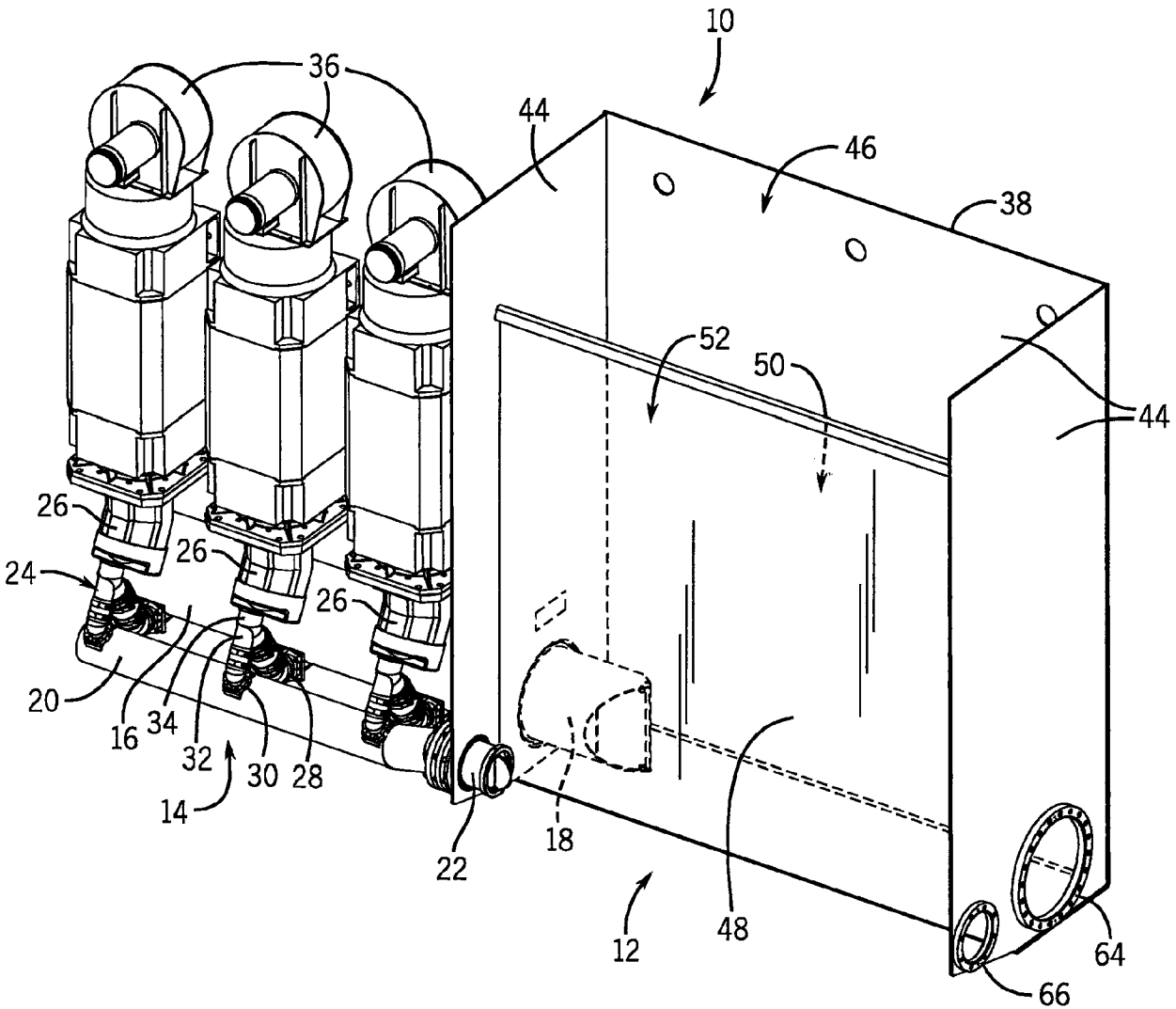
FIG. 2 is another perspective view of the hydraulic system of FIG. 1, but in which some of the walls of the hydraulic reservoir have been removed to expose the interior of the reservoir.

Referring first to FIGS. 1 and 2, a hydraulic system 10 is shown including a hydraulic reservoir 12 and a relevant portion of a hydraulic regenerative circuit 14. Typically, the hydraulic system 10 would be a part of a mining machine or other earth moving equipment and used to cause the actuation or large or heavy machine components via a connected piston and cylinder assembly or the like. Of course, the hydraulic system 10 could be adapted for any number of uses and is not limited to a particular type of machine.

At least in part, the hydraulic regenerative circuit 14 includes two manifolds or headers attached to the hydraulic reservoir 12. A suction header 16 is attached to the hydraulic reservoir 12 at a first one-way valve 18. A return header 20 is attached to the hydraulic reservoir 12 at a second one-way valve 22.

A plurality of hose/tube assemblies 24 place the suction header 16 and the return header 20 in valveless fluid communication with one another and with a corresponding plurality of hydraulic pumps 26. In the form shown, each of the hose/tube assemblies 24 include a first line 28 that extends from the suction header 16 and a second line 30 that extends from the return header 20. The first line 28 and second line 30 meet at a T-connection joint 32. A third line 34, also attached to the T-connection joint 32, runs from the T-connection joint 32 into the hydraulic pump 26. Thus, without any valves, the suction header 16 and the return header 20 are placed in fluid communication with the hydraulic pump 26 and also with one another. Of course, different connectivity may also be used. For example, a single set of interconnected hoses and/or tubes may place the both of the headers 16 and 20 in communication with all of the hydraulic pumps 26. Also, it is possible that there may only be a single hydraulic pump 26.

Each of the hydraulic pumps 26 is operably coupled to a corresponding electric motor 36. The hydraulic pump 26 and the electric motor 36 are capable of operating in a non-regenerative mode and a regenerative mode.

In the non-regenerative mode, the electric motor 36 drives the hydraulic pump 26 to pump hydraulic fluid from the hydraulic reservoir 12 via the suction header 16 into an attached hydraulic regenerative circuit 14 to cause mechanical work. This pumped hydraulic fluid may be used, for example, to actuate the motion of a piston within a cylinder.

In the regenerative mode, the hydraulic fluid is forced back through the hydraulic regenerative circuit 14 into the return header 20 and then into the hydraulic reservoir 12. Often, the weight of a component previously lifted by the hydraulic cylinder causes a reverse stroke of the piston, forcing the hydraulic fluid out of the cylinder and back through the hydraulic pump 26. In this mode, as the hydraulic fluid is forced back through the hydraulic pump 26, the hydraulic pump 26 drives the electric motor 36 which now acts as a generator. The generated electricity can be stored and/or used to power other features of the equipment. Alternatively, depending on the particular location and configuration of the system, this generated electricity could potentially be returned to an attached power grid.

In view of the general operating principle of the hydraulic regenerative circuit 14, the hydraulic reservoir 12 will now be described in more detail as will the specific flow patterns of the hydraulic fluid through the relevant portion of the hydraulic regenerative circuit 14.

The hydraulic reservoir 12 includes a container 38 including a top wall 40, a bottom wall 42, and four side walls 44 which define an internal volume 46 of the container 38. An internal wall 48 or baffle divides the internal volume 46 into a first section 50 and a second section 52. The first section 50 generally holds unused hydraulic fluid while the second section 52 generally holds used hydraulic fluid.

As used herein the terms "unused" and "used" are relative terms used to describe the hydraulic fluid. A used hydraulic fluid is fluid which has passed through the hydraulic regenerative circuit. An unused hydraulic fluid may either be fluid that has not yet been pumped into the hydraulic regenerative circuit 14 or may be fluid that has been pumped through the hydraulic regenerative circuit 14 to become used hydraulic fluid, but that has subsequently been altered in some way so that the used hydraulic fluid, after alteration, now again closely resembles unused fluid. This subsequent alteration may be, for example, filtering the hydraulic fluid to remove contaminants or debris or may be merely allowing the fluid to cool. Of course, it will be appreciated that even subsequent alteration may not completely return the used hydraulic fluid to the pristine state of hydraulic fluid that has never been used, but that the terms are used in a relative manner.

Returning to the structure of the hydraulic reservoir 12, the first section 50 of the hydraulic reservoir 12 is in one-way fluid communication with the suction header 16 via the first one-way valve 18. The first one-way valve 18 is installed in one of the walls 40, 42, and 44 that define the first section 50. The first one-way valve 18 allows the hydraulic fluid to be drawn out of the first section 50 and into the suction header 16, but substantially prevents the flow of the hydraulic fluid from the suction header 16 back into the first section 50 through the first one-way valve 18.

Likewise, the return header 20 is in one-way fluid communication with the second section 52 of the hydraulic reservoir 12 via the second one-way valve 22. The second one-way valve 22 is installed in one of the walls 40, 42, and 44 that define the second section 52. The second one-way valve 22 allows the hydraulic fluid to be returned to the second section 52 of the hydraulic reservoir 12 from the return header 20, but substantially prevents the flow of the hydraulic fluid out of the second section 52 and back into the return header 20 through the second one-way valve 22.

Figure 3:
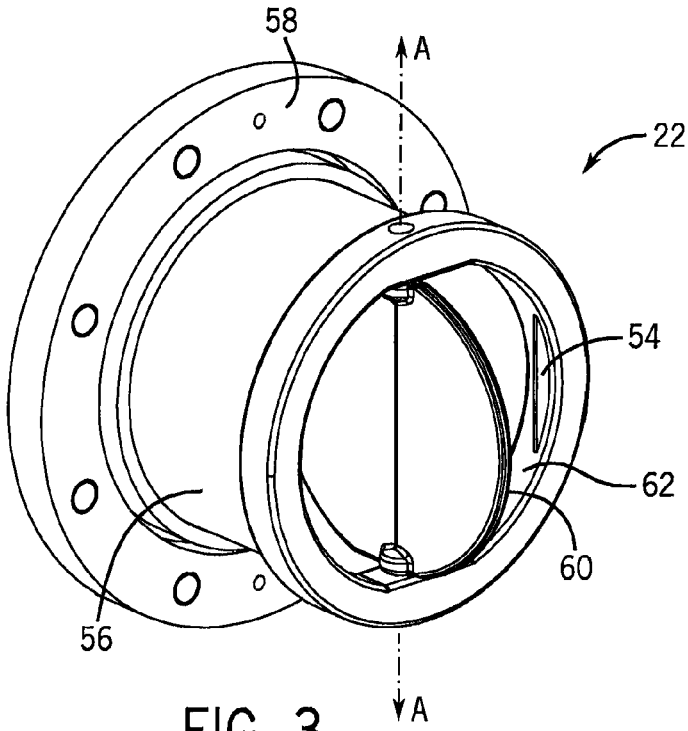
FIG. 3 is a perspective view of a one-way flapper valve in which the valve is open.
Figure 4:
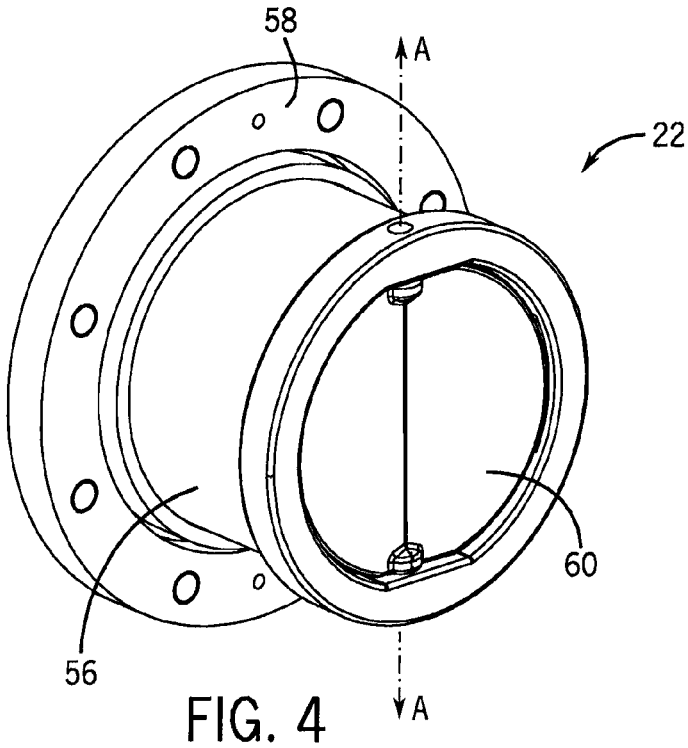
FIG. 4 is a perspective view of the valve of FIG. 3 in which the valve is closed.

Referring now to FIGS. 3 and 4, the details of the second one-way valve 22 is shown. Of course, it will be appreciated that the construction of the second one-way valve 22 will be similar to that of the first one-way valve 18 except that the first one-way valve 18 will be configured to open under an opposite pressure differential between the headers 16 and 20 and the hydraulic reservoir 12.

The second one-way valve 22 includes a tubular portion 56 that extends from a flange 58 on one end (for attachment to the wall 44 of the hydraulic reservoir 12) to an opening 62 on the other end. In the opening 62, a rotatable valve plate 60 is received which has an outer periphery with a shape that generally corresponds to the shape of the opening 62. The opening 62 also includes a lip 54 which restricts the pivotal range of the rotatable valve plate 60.

The rotatable valve plate 60 is allowed to hingedly pivot about an axis of rotation A-A approximately 90 degrees from an opened position, as shown in FIG. 3, to a closed position, as shown in FIG. 4 and visa-versa. The axis of rotation A-A of the rotatable valve plate 60 may be set or biased to one side of the rotatable valve plate 60 such that the axis of rotation A-A does not intersect the central axis of the channel running through the tubular portion. The placement of the rotational axis A-A, coupled with the restrictive placement of the lip 54, allows the valve to open under a positive pressure differential in one direction but not the other and limits the swing of the rotatable valve plate 60 such that it may only open in this single direction of flow. In the closed position, the rotatable valve plate 60 abuts the lip 54 and seals the opening 62 such that a reverse flow through the opening 62 is substantially prevented. In the opened position of FIG. 3, the rotatable valve plate 60 rotates approximately 90 degrees from the closed position such that the flat face of the rotatable valve plate 60 extends in a direction roughly parallel to the forward flow of the fluid through the flapper valve 22.

Although not explicitly shown in the drawings, it should be appreciated that the rotatable valve plate 60 may be biased by a biasing mechanism such as a spring or the like to the closed position. Then, when one of the sides of the flapper valve 22 has a pressure greater than the other side does the flapper valve 22 open to permit the flow of hydraulic fluid there through. Again, as the flapper valve 22 is configured to be a one-way valve, only when the pressure gradient from one particular side of the flapper valve 22 to the other side of the flapper valve 22 exceeds a predetermined differential will the rotatable valve plate 60 rotate to allow the passage of hydraulic fluid through the valve. A biasing mechanism may be particularly helpful if there are periods of time when there is no pressure differential across the valve 22, as otherwise the flapper valve 22 may drift open resulting in mixing of fluid in the circuit and the reservoir.

Figure 5:
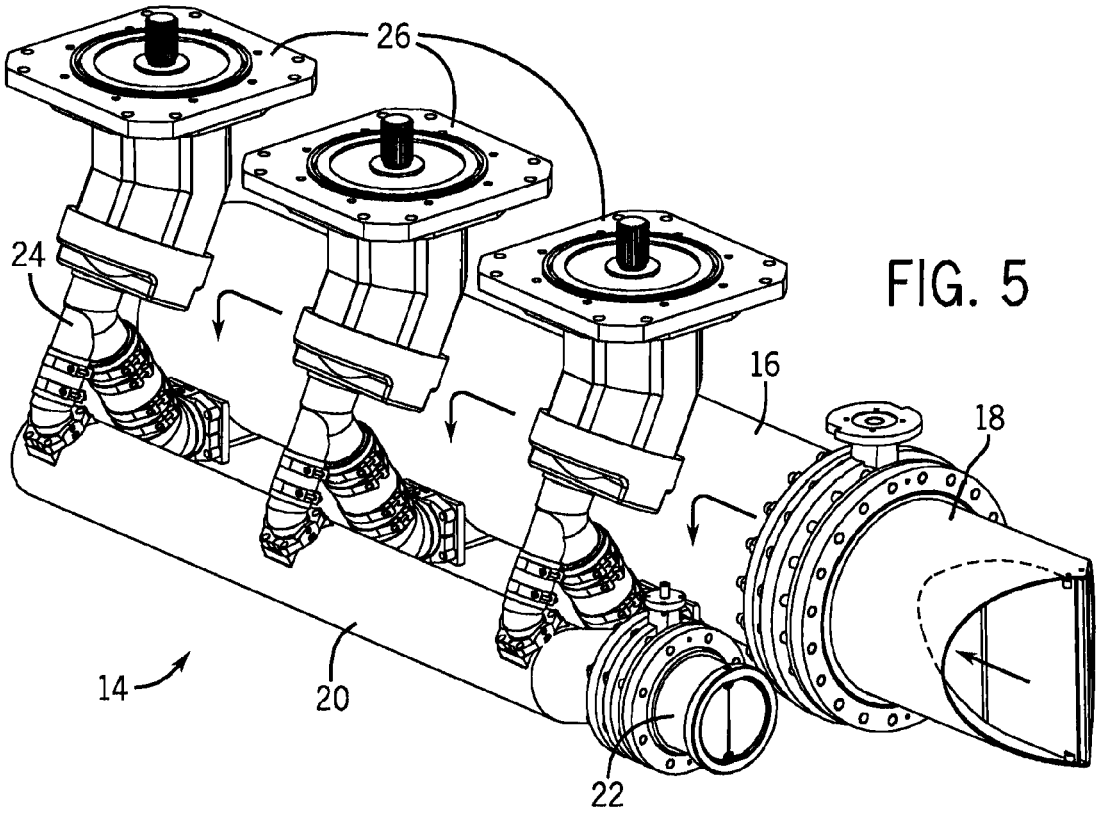
FIG. 5 is a detailed perspective view of the headers attached to the hydraulic reservoir in which the hydraulic system is operating in the non-regenerative mode.
Figure 6:
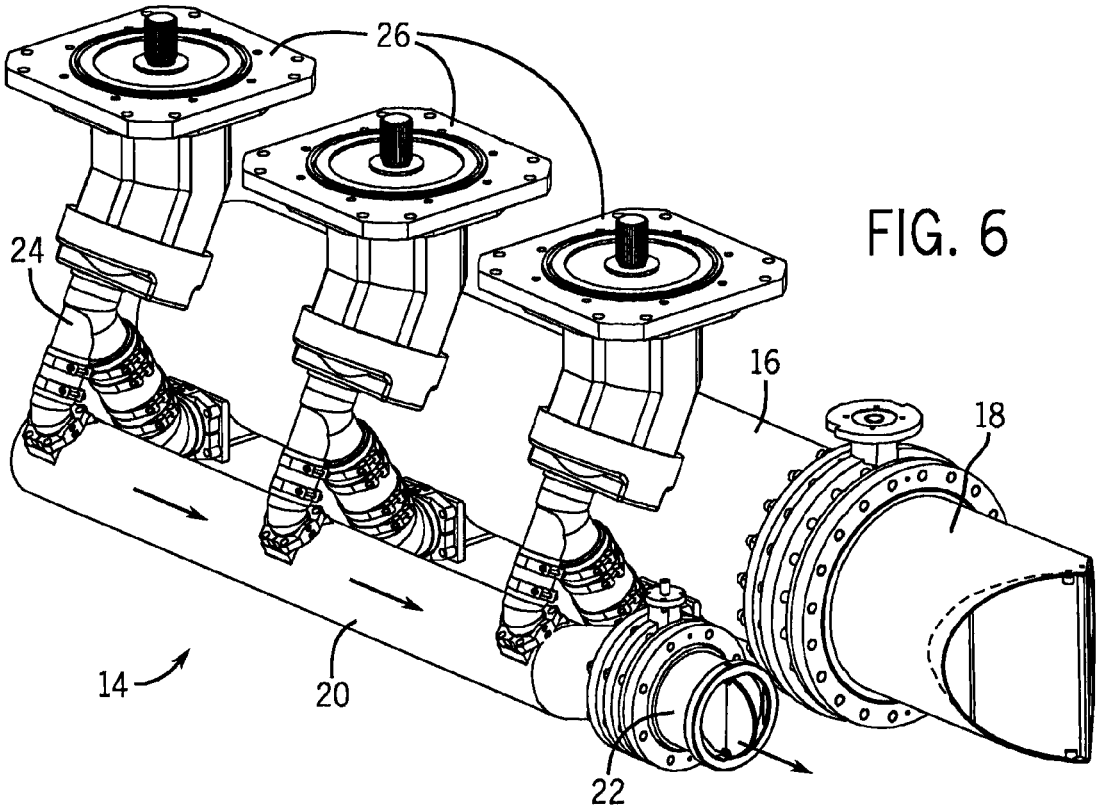
FIG. 6 is a detailed perspective view of the headers attached to the hydraulic reservoir in which the system is operating in the regenerative mode.

Referring now to FIGS. 5 and 6, the force exerted on the fluid when the hydraulic regenerative circuit 14 is operating in a non-regenerative mode and a regenerative mode, respectively are indicated by arrows.

Referring to FIG. 5, when the hydraulic system 10 is operated in a non-regenerative mode, the electric motors 36 drive the operation of the attached hydraulic pumps 26 to draw hydraulic fluid from the hydraulic reservoir 12. However, when this pumping action begins, unused hydraulic fluid may only be drawn from the first section 50 of the hydraulic reservoir 12 via the first one-way valve 18 into the suction header 16. The hydraulic fluid that enters the suction header 16 may then be drawn further into the hydraulic regenerative circuit 14 via the hose/tube assemblies 24 and the hydraulic pumps 26 to cause actuation of a hydraulic cylinder or to perform other hydraulic functions. Notably, as the second one-way valve 22 restricts the flow of the hydraulic fluid from the second section 52 of the hydraulic reservoir 12 into the hydraulic regenerative circuit 14, the pumping force of the hydraulic pumps 26 does not draw used hydraulic fluid out of second section 52 of the hydraulic reservoir 12.

Referring now to FIG. 6, when the hydraulic system 10 is operated in a regenerative mode, the hydraulic pumps 26 drive the operation of the electric motors 36 to generate electricity. In the regenerative mode, the hydraulic pumping of fluid from the hydraulic reservoir 12 into the hydraulic regenerative circuit 14 has stopped and the force of a return stroke of a previously actuated hydraulic cylinder or the like is now used to cause the hydraulic fluid to flow back through the hydraulic pumps 26. The reversing action of the hydraulic pumps 26 operates the electronic motors 36 which generates electricity.

After the fluid passes through the hydraulic pumps 26, it is directed back into the hydraulic reservoir 12. More specifically, the used hydraulic fluid is returned to the manifolds or headers 16 and 20 via the hose/tube assemblies 24. Despite the pressure differential, the first one-way valve 18 prevents the backwashing of used hydraulic fluid into the first section 50 of the hydraulic reservoir 12. Thus, the only fluid pathway for the hydraulic fluid during the regenerative mode is through the return header 20 and the second one-way valve 22 into the second section 52 of the hydraulic reservoir 12.

The used hydraulic fluid in the second section 52 of the hydraulic reservoir 12 may be subsequently processed (e.g., filtered) or otherwise altered (e.g., cooled) to return it to a condition substantially similar to the unused fluid. After being processed or otherwise altered, the used hydraulic fluid may be again used in the hydraulic regenerative circuit 14. To achieve this end, the hydraulic reservoir may also contain connections 64 and 66 (identified in FIG. 2), in the first section 50 and in the second section 52 respectively, which connect to a post-use loop 68 that may include mechanisms that clean or cool the hydraulic fluid to place it again in condition to be used in the hydraulic regenerative circuit 14.

Figure 7:
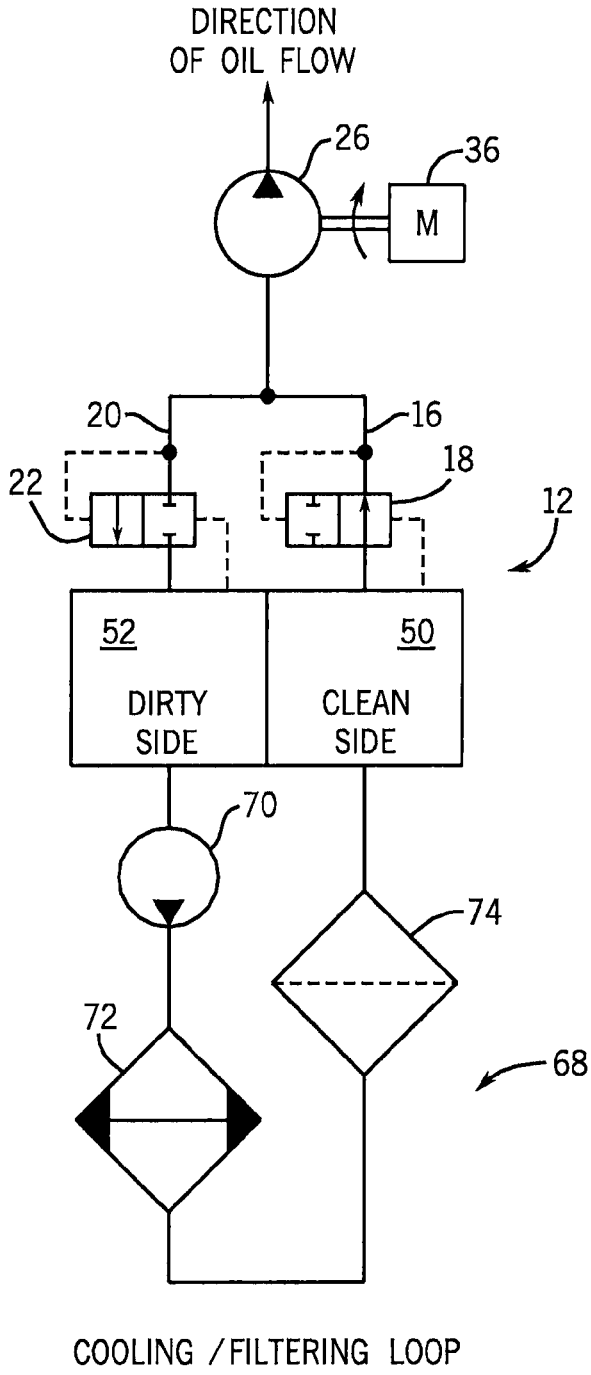
FIG. 7 is a hydraulic schematic of the hydraulic system in which the hydraulic fluid is flowing into the hydraulic regenerative circuit.
Figure 8:
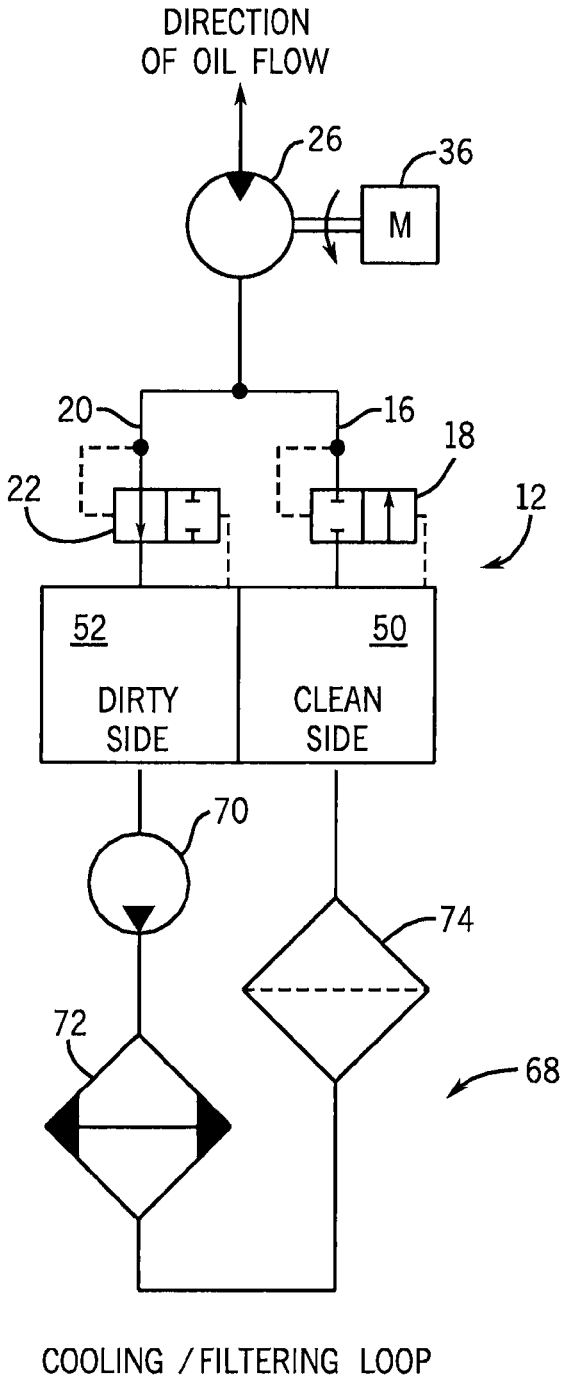
FIG. 8 is a hydraulic schematic of the hydraulic system in which the hydraulic fluid is flowing out of the hydraulic regenerative circuit.

Referring now to FIGS. 7 and 8, hydraulic schematics are provided in which the hydraulic fluid is shown flowing into and out of the hydraulic regenerative circuit 14, respectively. As shown in FIG. 7, in the forward direction, hydraulic fluid from the first section 50 of the hydraulic reservoir 12 is pumped into the hydraulic regenerative circuit 14. As shown in FIG. 8, in the reverse direction, hydraulic fluid returning from the hydraulic regenerative circuit 14 flows into the second section 52 of the hydraulic reservoir 12 without backwashing directly into the first section 50.

A post-use or cooling/filtering loop 68 moves hydraulic fluid from the second section 52 back into the first section 50 while simultaneously cooling and/or cleaning the hydraulic fluid so that the fluid may be reused. The cooling/filtering loop 68 includes a hydraulic pump 70 that pumps used hydraulic fluid from the second section 52 of the hydraulic reservoir 12 through a cooling element 72 and a filtering element 74 and then into the first section 50 of the hydraulic reservoir 12. This arrangement effectively cools and filters the used, hot, and/or dirty hydraulic fluid in the second section 52 of the hydraulic reservoir 12, returns the used fluid to a substantially clean or unused condition, and then transports the fluid back into the first section 50 where it may again be pumped into the hydraulic regenerative circuit 14.

It will be appreciated that the various elements of the cooling/filtering loop 68 may be rearranged in a different order, that some elements may be removed, and that other elements may also be included. For example, the pump 70 may be located downstream of or in between the cooling element 72 and the filtering element 74. Moreover, if temperature of the used hydraulic fluid does not present a substantial concern, for example, then the cooling element 72 may be eliminated.

Further, the hydraulic pump 70 may be run continuously or may be cycled based on the conditions of the fluid in the hydraulic reservoir 12. For example, the second section 52 of the hydraulic reservoir 12 may have a fluid level sensor or a fluid pressure sensor (not shown) for monitoring the fluid in the section. When a condition is met (e.g., a threshold volume is reached or exceeded), then the hydraulic pump 70 may be instructed to pump the used fluid from the second section 52 through the cooling/filtering loop 68 and return it in a substantially un-used condition to the first section 50 for re-use. Alternatively, sensors (not shown) in the first section 50 may determine whether the amount of fluid in the first section 50 needs to be replenished and may instruct the pump 70 to begin operating to draw fluid through the cooling/filtering loop 68.

Thus, a hydraulic system has been described having a hydraulic reservoir and a hydraulic regenerative circuit that prevents the mixing of used and unused hydraulic fluids. By separating these fluids in the reservoir, it is easier to efficiently clean and or replace the hydraulic fluid used in the circuit. Until now, the mixing of used and unused fluids has posed a special problem in hydraulic regenerative circuits, particularly given the alternating back and forth flow patterns of the fluid within the regenerative circuit. Yet, by implementation of the systems described herein, the mixing of such fluids is advantageously avoided in the hydraulic reservoir. Accordingly, the entire hydraulic system may operate more efficiently.

It should be appreciated that various other modifications and variations to the preferred embodiments can be made within the spirit and scope of the invention. Therefore, the invention should not be limited to the described embodiments. To ascertain the full scope of the invention, the following claims should be referenced.

What is claimed is:

1. A hydraulic reservoir for a hydraulic regenerative circuit, the hydraulic regenerative circuit including an electric motor that is operably coupled to a hydraulic pump in selective fluid communication with the hydraulic reservoir, the hydraulic regenerative circuit being operable in a non-regenerative mode in which the electric motor drives an operation of the hydraulic pump to draw a hydraulic fluid from the hydraulic reservoir and a regenerative mode in which the hydraulic pump drives an operation of the electric motor as the hydraulic fluid is returned to the hydraulic reservoir, the hydraulic reservoir comprising:

a container having an internal volume;

an internal wall dividing the internal volume of the container into a first section and a second section for separately containing the hydraulic fluid;

a first one-way valve that allows the hydraulic fluid to be drawn out of the first section and which substantially prevents a flow of the hydraulic fluid back into the first section through the first one-way valve; and a second one-way valve that allows the hydraulic fluid to be returned to the second section and which substantially prevents a flow of the hydraulic fluid back out of the second section through the second one-way valve.

2. The hydraulic reservoir of claim 1, wherein, in the non-regenerative mode, the hydraulic reservoir provides a hydraulic fluid from the first section into the hydraulic regenerative circuit without the hydraulic fluid substantially flowing back into the first section or flowing into the second section and wherein, in the regenerative mode, the hydraulic fluid flows from the hydraulic regenerative circuit into the second section without the hydraulic fluid in the second section substantially flowing back into the hydraulic regenerative circuit or flowing into the first section thereby preventing mixing of a used hydraulic fluid with an unused hydraulic fluid.

3. The hydraulic reservoir of claim 2, wherein the first section holds a clean hydraulic fluid and the second section holds a dirty hydraulic fluid and the internal wall isolates the clean hydraulic fluid from the dirty hydraulic fluid.

4. The hydraulic reservoir of claim 2, wherein the first section holds a cold hydraulic fluid and the second section holds a hot hydraulic fluid and the internal wall isolates the cold hydraulic fluid from the hot hydraulic fluid.

5. The hydraulic reservoir of claim 1, wherein the first one-way valve is adapted for connection to a suction header.

6. The hydraulic reservoir of claim 1, wherein the second one-way valve is adapted for connection to a return manifold.

7. The hydraulic reservoir of claim 1, wherein at least one of the first one-way valve and the second one-way valve is a flapper valve that allows the hydraulic fluid to flow in only one direction there through.

8. The hydraulic reservoir of claim 1, wherein the internal wall prevents mixture of the hydraulic fluid in the first section and the second section, but allows for gaseous interchange in a space above the first section and the second section.

9. A hydraulic system comprising:

a hydraulic reservoir including:

a container having an internal volume;

an internal wall dividing the internal volume of the container into a first section and a second section for separately containing a hydraulic fluid;

a first one-way valve that allows the hydraulic fluid to be drawn out of the first section and which substantially prevents a flow of the hydraulic fluid back into the first section through the first one-way valve;

a second one-way valve that allows the hydraulic fluid to be returned to the second section and which substantially prevents a flow of the hydraulic fluid back out of the second section through the second one-way valve; and a hydraulic regenerative circuit including:

a hydraulic pump in selective fluid communication with the hydraulic reservoir;

an electric motor operably coupled to the hydraulic pump;

wherein the hydraulic regenerative circuit is operable in a non-regenerative mode in which the electric motor drives an operation of the hydraulic pump to draw a hydraulic fluid from the hydraulic reservoir and a regenerative mode in which the hydraulic pump drives an operation of the electric motor as the hydraulic fluid is returned to the hydraulic reservoir.

10. The hydraulic system of claim 9, wherein, in the non-regenerative mode, the hydraulic reservoir provides a hydraulic fluid from the first section into the hydraulic regenerative circuit without the hydraulic fluid substantially flowing back into the first section or flowing into the second section and wherein, in the regenerative mode, the hydraulic fluid flows from the hydraulic regenerative circuit into the second section without the hydraulic fluid in the second section substantially flowing back into the hydraulic regenerative circuit or flowing into the first section, thereby preventing mixing of a used hydraulic fluid with an unused hydraulic fluid.

11. The hydraulic system of claim 9, wherein the first one-way valve is connected to a suction header and the second one-way valve is connected to a return header.

12. The hydraulic system of claim 11, wherein the suction header and the return header are placed in valveless fluid communication with the hydraulic pump and with one another.

13. The hydraulic system of claim 9, further comprising a post-use loop with at least one of a hydraulic pump, a cooling element, and a filtering element for taking the hydraulic fluid in the second section and returning the hydraulic fluid to the first section in a substantially unused condition.

14. A method of operating a hydraulic system including a hydraulic regenerative circuit attached to a hydraulic reservoir such that an unused hydraulic fluid and a used hydraulic fluid remain substantially unmixed in the hydraulic reservoir, the method comprising:

providing the hydraulic reservoir, the hydraulic reservoir including a container having an internal wall dividing an internal volume of the container into a first section and a second section for separately containing the unused hydraulic fluid and the used hydraulic fluid, respectively, the hydraulic reservoir further including a first one-way valve that allows the unused hydraulic fluid to flow from the first section into the hydraulic regenerative circuit, but substantially prevents the a flow of the used hydraulic fluid in the hydraulic regenerative circuit back into the first section through the first one-way valve and a second one-way valve that allows the used hydraulic fluid in the hydraulic regenerative circuit to flow into the second section, but substantially prevents the used hydraulic fluid from flowing back into the hydraulic regenerative circuit through the second one-way valve;

during a non-regenerative phase, using an electric motor to drive a hydraulic pump to draw the unused hydraulic fluid from the first section of the hydraulic reservoir into the hydraulic regenerative circuit; and during a regenerative phase, using the hydraulic pump to drive the electric motor as the used hydraulic fluid is transported into the second section of the hydraulic reservoir from the hydraulic regenerative circuit.

15. The method of claim 14, further comprising the step of pumping the fluid from the second section through a post-use loop into the first section, wherein the post-use loop contains at least one of a hydraulic pump, a cooling element, and a filtering element that return the hydraulic fluid from the second section into the first section in a substantially unused condition.

* * * * *